US006733335B2

(12) United States Patent
Wu

(10) Patent No.: US 6,733,335 B2
(45) Date of Patent: May 11, 2004

(54) ELECTRICAL CONNECTOR HAVING RETENTION SYSTEM FOR MOUNTING ONTO A PRINTED CIRCUIT BOARD

(75) Inventor: Jerry Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/159,412

(22) Filed: May 31, 2002

(65) Prior Publication Data

US 2003/0224654 A1 Dec. 4, 2003

(51) Int. Cl.[7] ..... H01R 13/00
(52) U.S. Cl. ..... 439/570; 439/79; 439/573
(58) Field of Search ..... 439/573, 79–81, 439/544, 562, 567, 570

(56) References Cited

U.S. PATENT DOCUMENTS 4,679,883 A * 7/1987 Assini et al. ..... 439/607
5,178,557 A * 1/1993 Hashiguchi ..... 439/357
5,230,633 A * 7/1993 Hisatomi et al. ..... 439/79
5,405,267 A * 4/1995 Koegel et al. ..... 439/79
5,622,519 A * 4/1997 Bixler et al. ..... 439/570
5,897,386 A * 4/1999 Baxter et al. ..... 439/79
6,382,984 B1 * 5/2002 Yu ..... 439/64
6,527,564 B1 * 3/2003 Yeh ..... 439/76.1

* cited by examiner

*Primary Examiner*—Hien Vu
(74) *Attorney, Agent, or Firm*—Wei Te Chung

(57) ABSTRACT

An electrical connector (1) includes an insulative housing (10) mounted for an edge of a printed circuit board (6), and a plurality of contacts (12) being received in recesses (20) defined in the insulative housing. The insulative housing has an elongated body portion (14), a mating portion (18) projecting forwardly from the body portion, a pair of guide portions (16) positioned on both ends of the body portion, and a back portion (34) extending rearwardly from the body portion. A plurality of posts (40) projects downwardly from each of the guide portions to extend through the printed circuit board. The insulative housing defines a plurality of apertures (42) corresponding to each post.

4 Claims, 4 Drawing Sheets

ELECTRICAL CONNECTOR HAVING RETENTION SYSTEM FOR MOUNTING ONTO A PRINTED CIRCUIT BOARD

BACKGROUND OF THE INVENTION

1. Field of the Invention

The present invention relates to an electrical connector, and particularly to an electrical connector having a retention system for facilitating mounting of the electrical connector on a printed circuit board.

2. Description of Related Art

It is well known to provide an electrical connector mountable to a printed circuit board (hereinafter PCB), in which the connector has terminals electrically engaging with respective electrical circuit traces on the PCB. The terminals may have solder tails projecting from the connector and inserted into holes in the PCB, or leg portions extending generally parallel to the PCB for surface mounting to circuit traces on the PCB. Such a connector has a problem that the electrical connections between the terminals and the circuit traces of the PCB often are subjected to external stresses, which sometimes will cause the connections to break. To resolve this problem, U.S. Pat. Nos. 5,622,519, 5,217,381, 5,230,633, 5,178,557 and 4,679,883, disclose the use of board locks and posts to retain the connectors to the printed circuit boards.

However, with the ever-increasing miniaturization of electronic circuit, along with the consequent reduction in sizes of the connector and terminals, the board locks often are impractical and neither cost nor space effective.

Regarding the posts, which extend vertically from the dielectric housing of the electrical connector for insertion into the printed circuit board, the posts result in a difficulty in molding the housing. Because the housing has generally a mating port extending along a horizontal direction, a mold open direction of the mold for forming the housing is in a horizontal direction. To form the vertically extending posts, slide structure is necessary in the mold. The slide structure increases the cost and operating complication of the mold. Furthermore, for a board edge mounting electrical connector, a mating/unmating force of the connector will cause the connector to rotate, whereby the connections of the tails of the connector and the PCB are insecure. Hence, an improvement to resolve the problems of the prior art is required. The copending application Ser. No. 09/938,442 filed on Aug. 23, 2001, with the same inventor and the same assignee discloses some approach.

SUMMARY OF THE INVENTION

Accordingly, the object of the present invention is to provide an electrical connector for facilitating mounting of the electrical connector onto a PCB.

In order to achieve the object set forth, an electrical connector comprises an insulative housing adapted for being mounted to an edge of a printed circuit board, and a plurality of contacts secured to the housing. The housing has an elongated body portion. A mating portion projects forwardly from the body portion adapted for engaging with a complementary connector and defines a plurality of recesses therein. A pair of guide portions is positioned on both ends of the body portion. A back portion extends rearwardly from the body portion. A post projects downwardly from each of the guide portions for extending through holes defined in the printed circuit board. A pole projects downwardly from the back portion for retentively engaging in a hole of the printed circuit board. The insulative housing defines apertures at locations corresponding to positions of the posts and pole, respectively. The apertures are located in front of and in line with the posts and pole, respectively. Each aperture has a size larger than a corresponding post or pole.

Other objects, advantages and novel features of the invention will become more apparent from the following detailed description when taken in conjunction with the accompanying drawings.

DETAILED DESCRIPTION OF THE INVENTION

Figure 1:
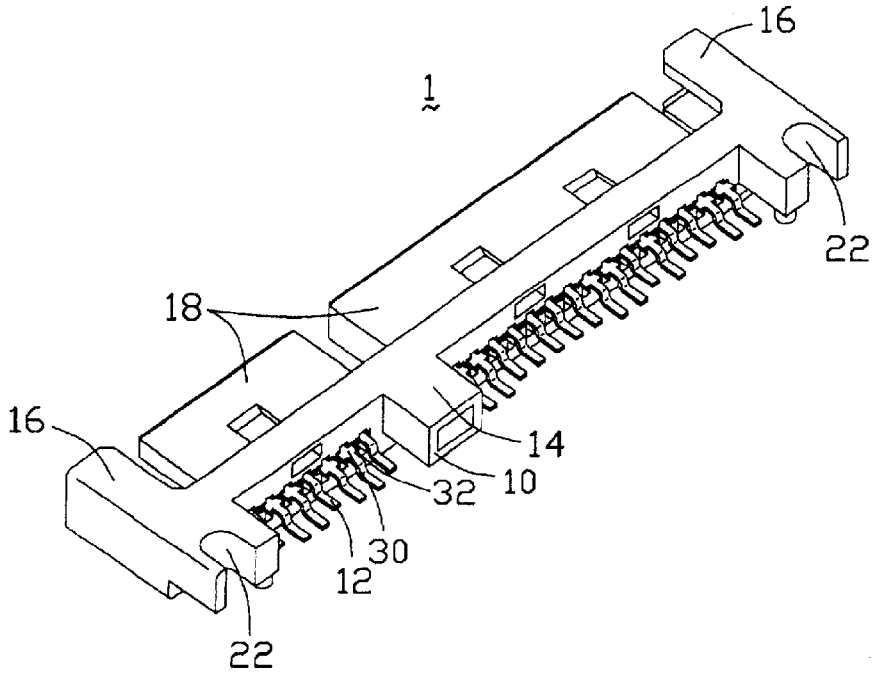
FIG. 1 is a top perspective view of an electrical connector in accordance with the present invention.
Figure 2:
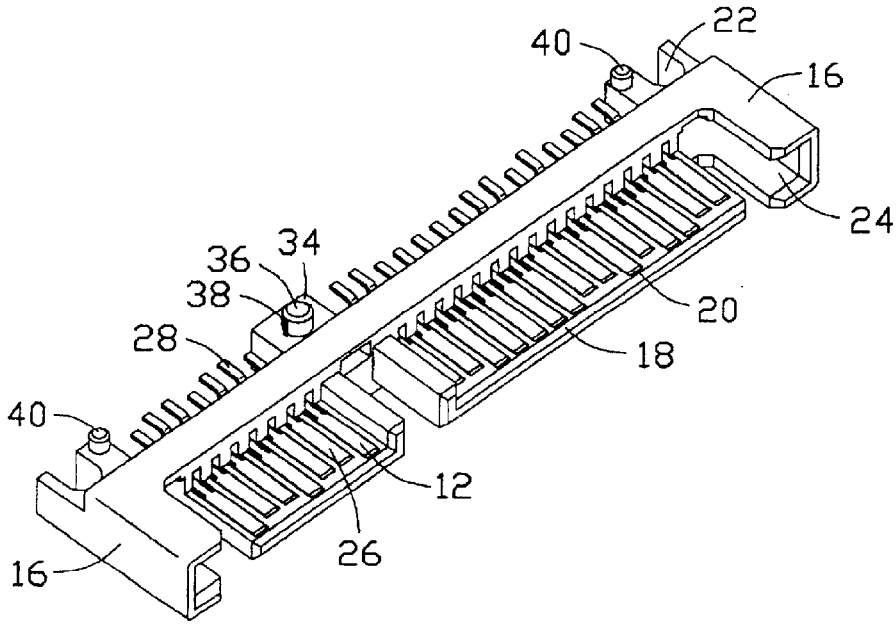
FIG. 2 is a bottom perspective view of the electrical connector of FIG. 1.

Referring first to FIGS. 1 and 2, an electrical connector 1 of the present invention is for mounting to a PCB 6 (shown in FIG. 6) received in the a hard disk (not shown) whereby information can be transmitted between the hard disk and another electronic device. The connector 1 comprises an insulative housing 10 and a plurality of contacts 12 received in the insulative housing 10. The insulative housing 10 has an elongated body portion 14 and a pair of guide portions 16 projecting forwardly from both ends of the body portion 14. Two mating portions 18 project forwardly from the body portion 14 to engage with a complementary connector (not shown). A plurality of recesses 20 is defined in each of the mating portions 18 for receiving contact portions of the contacts 12. Along the mating direction, each of guide portions 16 defines a guiding channel 24. A U-shaped groove 22 which has an arced front end, is formed in each of the guide portions 16. The groove 22 is opposite to the guide channel 24.

The contacts 12 each includes a contact portion 26 in a respective recess 20 of the mating portions 18 and a tail portion 28 projecting rearwardly of the body portion 14 for electrically engaging with the PCB 6 to transfer and receive signals to/from circuit traces (not labelled) on the PCB 6. In addition, a retaining portion 30 with a pair of teeth 32 is disposed between the contact portion 26 and the tail portion 28, and engages in the body portion 14.

A back portion 34 extends rearwardly of the body portion 14. A cylindrical pole 36, which has a pair of wings 38, projects downwardly from the back portion 34. Furthermore, a post 40, which has a diameter smaller than that of the pole 36, projects downwardly from an inner side of each guide portion 16. It is noted that there is a step formed around a rear portion of the housing with a higher surface of the housing thereon, from which the post 40 and the pole 36 extend downwardly.

Figure 3:
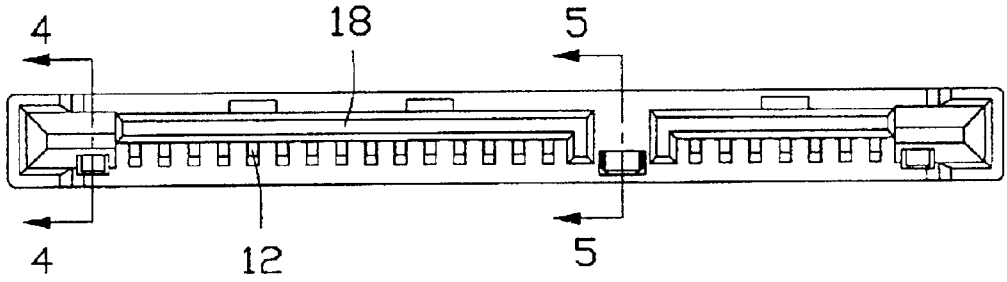
FIG. 3 is a front elevational view of the electrical connector of FIG. 1.
Figure 4:
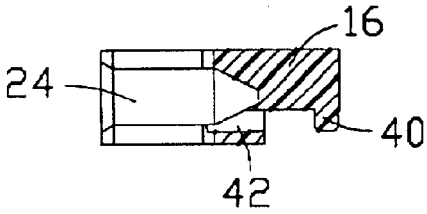
FIG. 4 is a cross-sectional view taken along line 4—4 of FIG. 3 with contacts of the connector being removed to facilitate the illustration.
Figure 5:
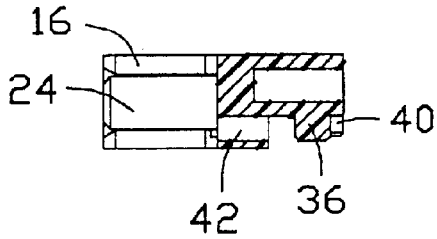
FIG. 5 is a cross-sectional similar to FIG. 4 but taken along line 5—5 of FIG. 3.

As shown in FIGS. 3, 4 and 5, an important feature of the present invention is disclosed. In order to facilitate molding of the pole 36 and posts 40, three apertures 42 are horizontally defined through the insulative housing 10 in a front-to-rear direction and at locations corresponding to the positions of the pole 36 and the posts 40, respectively. The apertures 42 are located in front of and in line with the pole 36 and posts 40, respectively. Each aperture 42 has a width which is larger than a diameter of a corresponding post 40 or pole 36. Furthermore, each of the posts and pole 36, 40 has a bottom which is above a bottom of a corresponding aperture 42, whereby the posts 40 or pole 36 can be formed by a horizontally movable mold block, without the necessity to use a slide structure in the mold.

Figure 6:
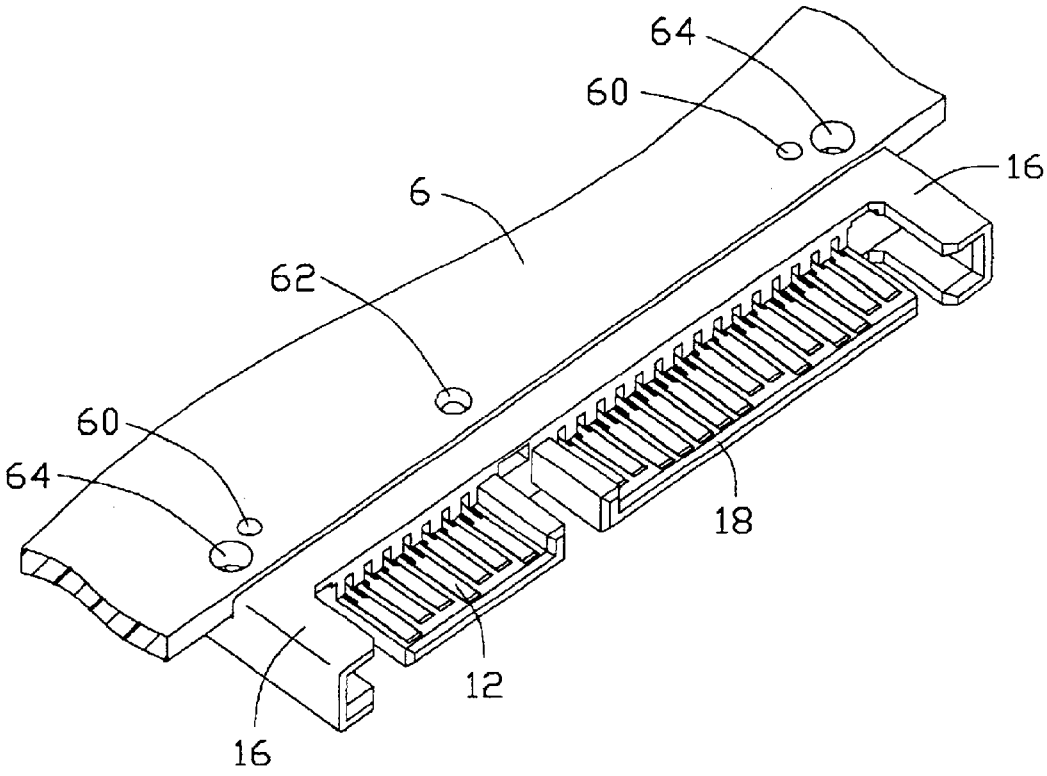
FIG. 6 is a bottom perspective view of the electrical connector assembled onto a PCB.
Figure 7:
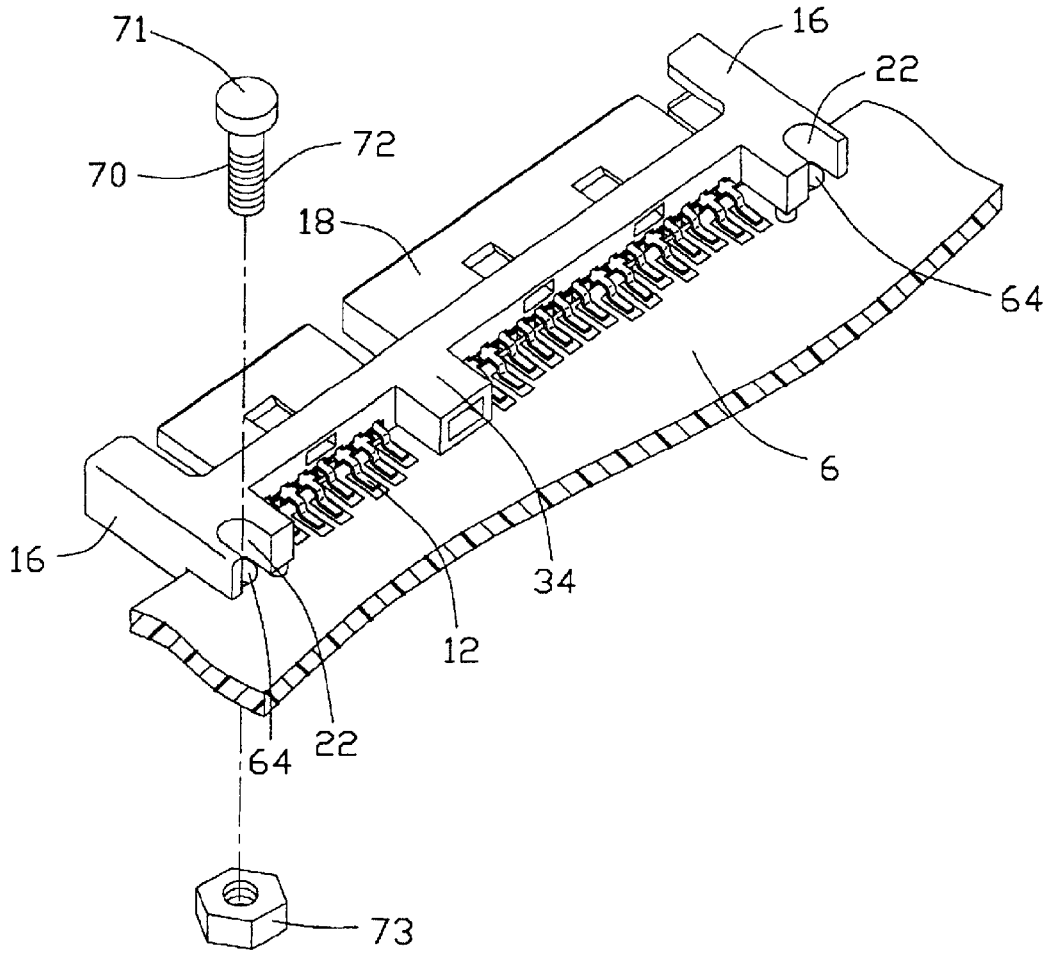
FIG. 7 is a view similar to FIG. 6, from a top aspect.

Referring to FIGS. 6 and 7, the PCB 6 defines a pair of first holes 60 for receiving the posts 40, a second hole 62 for the insertion of the pole 36, and a pair of third holes 64 beside the first holes 60 and near an edge thereof. In assembly, the posts 40 are received in the first holes 60 and the pole 36 is received in the second hole 62, respectively. The pair of wings 38 of the pole 36 engages with the PCB 6, whereby retaining the connector 1 to the PCB 6. Thereafter the connector 1 together with the PCB 6 is subject to infrared (IR) reflow to surface mounting the solder tails 28 of the contacts 12 to the circuit traces of the PCB 6. Finally, a pair of screw/nut devices (only one shown) are used to further secure the connector 1 to the PCB 6. Each screw/nut device comprises a screw 70 having a head and a threaded portion 72, and a nut 73. The threaded portion 72 is brought to extend through a corresponding third hole 64 from a top to a bottom of the PCB 6, in which the head 71 of the screw 70 is engagingly fitted in the arced front end of a corresponding U-shaped groove 22. A mating force acting on the connector 1 by inserting a complementary connector into the connector 1 can be effectively resisted by the engagement between the heads 71 of the screws 70 and the housing 10; thus a rotation of the connector 1 caused by the mating force can be avoided.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claim is:

1. An electrical connector comprising:

an insulative housing adapted for being mounted to an edge of a printed circuit board, the housing having an elongated body portion, a mating portion projecting forwardly from the body portion adapted for engaging with a complementary connector and defining a plurality of recesses therein, a pair of guide portions positioned on both ends of the body portion, and a back portion extending rearwardly from the body portion, a post projecting downwardly from each of the guide portions adapted for extending through holes defined in the printed circuit board, a pole projecting downwardly from the back portion adapted for retentively engaging in a hole of the printed circuit board, said insulative housing defining apertures being located in front of and in line with the posts and pole, respectively, each aperture having a size larger than a corresponding post or pole; and a plurality of contacts secured to the housing, each contact having a contact portion received in a corresponding recess; wherein the guide portions each defines a channel adapted for guiding the complementary connector to mate with the electrical connector, and a groove adapted for fittingly receiving a screw, the groove being opposite to the channel; wherein the pole has a pair of wings located on opposite sides thereof.

2. The electrical connector as described in claim 1, wherein each post is positioned at an inner side of a corresponding guide portion.

3. An electrical connector comprising:

an insulative housing mounted to an edge of a printed circuit board, the housing having an elongated body portion, a mating portion projecting forwardly from the body portion adapted for engaging with a complementary connector and defining a plurality of recesses therein, a pair of guide portions positioned on both ends of the body portion, and a back portion extending rearwardly from the body portion, a post projecting downwardly from each of the guide portions extending through holes defined in the printed circuit board, a pole projecting downwardly from the back portion retentively engaging in a hole of the printed circuit board, each guide portion having a forwardly extending channel adapted for guiding the complementary connector to mate with the electrical connector, and a groove opposite the channel, a screw being fittingly received in the groove and through the printed circuit board, and a nut threadedly engaging the screw at a bottom of the printed circuit board; and a plurality of contacts secured to the housing, each contact having a contact portion received in a corresponding recess; wherein front-to-rear extending apertures are formed in the housing respectively in front of and in line with the posts and the pole, each aperture having a dimension larger than a corresponding post or pole; wherein the grooves each are U-shaped and have an arced front end; wherein the pole has a pair of wings on opposite side thereof.

4. An electrical connector assembly comprising:

a printed circuit board defining an upper surface thereon;

an insulative housing defining a bottom face and a step around a rear portion thereof, a higher horizontal surface of said housing being defined on said step, a front edge portion of the printed circuit board received in the step with the higher surface of the housing seated upon the upper surface of the printed circuit board;

a plurality of terminals received in the housing;

a post integrally formed with the housing by injection molding and downwardly extending from the higher surface of the housing; and an aperture formed in the housing, said aperture being spaced from and in aligned with said post in a front-to-back direction and dimensioned to be large enough to expose the whole post in said front-to-back direction; wherein said aperture does not extend downwardly through said bottom face.

* * * * *